US012336680B2

(12) United States Patent
Almus et al.

(10) Patent No.: US 12,336,680 B2
(45) Date of Patent: Jun. 24, 2025

(54) DISHWASHER WITH AT LEAST ONE AIR OUTLET

(71) Applicant: BSH Hausgeräte GmbH, Munich (DE)

(72) Inventors: Alexander Almus, Bissingen (DE); Thomas Burggraf, Dillingen (DE); Klaus Steinle, Thierhaupten (DE)

(73) Assignee: BSH Hausgeräte GmbH, Munich (DE)

( * ) Notice: Subject to any disclaimer, the term of this patent is extended or adjusted under 35 U.S.C. 154(b) by 250 days.

(21) Appl. No.: 18/021,223

(22) PCT Filed: Sep. 30, 2021

(86) PCT No.: PCT/EP2021/076965
§ 371 (c)(1),
(2) Date: Feb. 14, 2023

(87) PCT Pub. No.: WO2022/069646
PCT Pub. Date: Apr. 7, 2022

(65) Prior Publication Data

US 2023/0292984 A1 Sep. 21, 2023

(30) Foreign Application Priority Data

Sep. 30, 2020 (DE) ..... 102020212345.4

(51) Int. Cl.
*A47L 15/48* (2006.01)
*A47L 15/42* (2006.01)

(52) U.S. Cl.
CPC ..... *A47L 15/488* (2013.01); *A47L 15/4251* (2013.01); *A47L 15/483* (2013.01);
(Continued)

(58) Field of Classification Search
CPC ..... A47L 15/486; A47L 15/488; A47L 15/00–508
See application file for complete search history.

(56) References Cited

U.S. PATENT DOCUMENTS 4,179,821 A 12/1979 Herbst
5,881,746 A 3/1999 Buser
(Continued)

FOREIGN PATENT DOCUMENTS

DE 29601313 U1 6/1996
DE 19604370 A1 6/1997
(Continued)

OTHER PUBLICATIONS

International Search Report PCT/EP2021/076965 dated Nov. 5, 2021.

*Primary Examiner* — Spencer E. Bell
(74) *Attorney, Agent, or Firm* — Michael E. Tschupp; Andre Pallapies; Brandon G. Braun

(57) ABSTRACT

A dishwasher includes a dishwasher cavity for treatment of items to be washed, and an air outlet for blowing out air from the dishwasher cavity. The air outlet is arranged in a lower quarter of a height of the dishwasher and extends as a slotted outlet over at least two thirds of a width of the dishwasher. A connection located on a rear face of the air outlet introduces humid air into the air outlet and is designed to supply the introduced air to an air distributor for separating the supplied air into differently oriented sub-flows.

16 Claims, 4 Drawing Sheets

(52) U.S. Cl.
CPC ..... *A47L 15/486* (2013.01); *A47L 2401/19* (2013.01); *A47L 2501/12* (2013.01)

(56) References Cited

U.S. PATENT DOCUMENTS

| | | | | |
|---|---|---|---|---|
| 8,313,583 | B2 | 11/2012 | May | |
| 9,888,829 | B1 | 2/2018 | Bongivengo | |
| 10,024,561 | B2 | 7/2018 | Olson | |
| 2010/0043250 | A1 | 2/2010 | Berends | |
| 2010/0083991 | A1* | 4/2010 | Tolf | A47L 15/488 134/95.2 |
| 2011/0126864 | A1 | 6/2011 | Kim | |
| 2011/0241503 | A1 | 10/2011 | Simon | |
| 2013/0206186 | A1 | 8/2013 | Tang | |
| 2014/0170954 | A1* | 6/2014 | Hintz | A47L 15/48 454/251 |
| 2014/0360534 | A1 | 12/2014 | Olson | |
| 2016/0022116 | A1* | 1/2016 | Delellis | A47L 15/486 34/218 |
| 2017/0290489 | A1 | 10/2017 | Noriega | |
| 2018/0125329 | A1 | 5/2018 | Parmeggiani | |
| 2021/0100424 | A1 | 4/2021 | Tan | |

FOREIGN PATENT DOCUMENTS

| | | | | |
|---|---|---|---|---|
| DE | 19704430 | A1 | 8/1998 | |
| EP | 0378836 | A1 | 7/1990 | |
| EP | 0521815 | A1 | 1/1993 | |
| EP | 2682038 | A2 | 1/2014 | |
| EP | 3020319 | A1 | 5/2016 | |
| EP | 3427628 | A1 | 1/2019 | |
| JP | 2018140243 | A | 9/2018 | |
| KR | 101308832 | B1 | 9/2013 | |
| KR | 101685357 | B1 | 12/2016 | |
| WO | 2013090155 | A1 | 6/2013 | |
| WO | WO-2015107474 | A1 * | 7/2015 | A47L 15/486 |

* cited by examiner

DISHWASHER WITH AT LEAST ONE AIR OUTLET

CROSS-REFERENCES TO RELATED APPLICATIONS

This application is the U.S. National Stage of International Application No. PCT/EP2021/076965, filed Sep. 30, 2021, which designated the United States and has been published as International Publication No. WO 2022/069646 A1 and which claims the priority of German Patent Application, Serial No. 10 2020 212 345.4, filed Sep. 30, 2020, pursuant to 35 U.S.C. 119 (a)-(d).

The contents of International Application No. PCT/EP2021/076965 and German Patent Application, Serial No. 10 2020 212 345.4 are incorporated herein by reference in their entireties as if fully set forth herein.

BACKGROUND OF THE INVENTION

The present invention relates to a dishwasher with at least one air outlet for blowing out air, in particular humid air, from a dishwasher cavity in which dishware, glasses, cutlery and similar items to be washed can be treated.

In such dishwashers it is desirable to be able to remove the items to be washed from the dishwasher cavity, with the items to be washed being dried as completely as possible and without water stains.

For an effective drying result of dishware, glasses, cutlery and similar items which can be treated in a dishwasher cavity, it is advantageous to be able to remove humid air from the dishwasher cavity for effective drying. It is thus known to connect the dishwasher cavity to an air outlet which transports humid air from the dishwasher cavity into the external surroundings. Thus an air outlet is frequently located in the upper region of a front door which can be opened and closed. Supplying air into this moving unit is thus relatively complex and expensive, and due to the arrangement at the top of the appliance there is the risk that cabinets or countertops located above the dishwasher or even parts of the dishwasher and the housings thereof are damaged by the high level of escaping moisture or that the kitchen floor becomes wet and thus slippery in the region in front of the dishwasher. Additionally, significant air drafts can occur in the vicinity of such an air outlet, which is very uncomfortable particularly in small kitchens where the users sit in the vicinity of a dishwasher.

BRIEF SUMMARY OF THE INVENTION

The object of the invention is to avoid to the greatest possible extent water vapor acting on surrounding items of furniture, the kitchen floor and front parts of the dishwasher, together with an attractive visual arrangement.

The invention solves this problem by way of a dishwasher, in particular a household dishwasher.

If spatial and/or location information is provided within the context of the invention, this is preferably to be understood to mean from a standpoint which a user adopts in front of the household dishwasher according to the invention, when using and/or operating the dishwasher as intended, when this household dishwasher is positioned or installed ready for operation.

Since according to the invention at least one air outlet is arranged in the lower quarter of the appliance height, when water vapor rises from the air outlet it initially acts on the dishwasher itself so that a portion of the water can condense here and not reach the items of furniture located thereabove. Additionally, since the air outlet extends as a slotted outlet over at least two thirds of the width of the dishwasher, a wide distribution of the escaping moisture and a thorough mixing with the drier external air in the room is achieved. The humid air escaping into the surroundings at the respective place of installation of the dishwasher is distributed such that a significant input of moisture at certain points into the items of furniture is avoided. The air drafts are also considerably reduced by the effective distribution width of the air. The large width of the air outlet can be effectively used for the air since at least one connection, which in particular is located on the rear face, is provided for introducing humid air into the air outlet, said connection being used to supply the introduced air to at least one air distributor which separates the supplied air into differently oriented sub-flows and supplies these sub-flows to the air outlet, so as to be distributed over the width extent or transverse extent of the air outlet, in particular so as to be distributed as uniformly as possible. The pre-division of the dishwasher-interior air supplied via the inlet-side connection into the sub-flows ensures that air can escape over the entire width of the air outlet into the room in front of the dishwasher.

In particular, the air distributor can be assigned to the inlet-side connection and/or arranged downstream thereof. The air distributor is arranged upstream of the slotted blow-out channel of the air outlet. This air distributor preferably separates the dishwasher-interior airflow, which is supplied to the connection, into a left-hand sub-flow and a right-hand sub-flow. In this case, the left-hand sub-flow is fed into the left-hand portion and the right-hand sub-flow is fed into a right-hand sub-portion of an upwardly protruding air channel. This air channel, when viewed in the direction of flow, is arranged upstream of the slotted blow-out channel of the air outlet. The air channel is preferably located lower than the air outlet, when viewed in the vertical direction. The air channel preferably extends substantially over the same width extent as the blow-out channel. In particular, the upper end thereof is connected to the inlet of the blow-out channel extending to the front over the entire width thereof (when viewed from the front). The air inlet with the connection is preferably provided approximately in the center of the width extent of the air channel in the rear wall thereof. The upwardly protruding air channel can thus advantageously function as a condensation region. Preferably, the hollow space of the air channel is closed at its lower end in an air-tight and/or water-tight manner, so that in its lower region it forms a condensate collecting tank. In this manner, when viewed from the front, the air distributor ensures that a left-hand sub-flow of the dishwasher-interior airflow, which is supplied to the inlet-side connection, acts on the left-hand half of the upwardly protruding air channel upstream of the air outlet and the adjoining left-hand half of the blow-out channel of the air outlet, which extends to the front and in the width direction or transverse direction, and a right-hand sub-flow of the dishwasher-interior airflow, which is supplied to the inlet-side connection, acts on the right-hand half of the upwardly protruding air channel and the adjoining right-hand half of the blow-out channel of the air outlet, which extends to the front, when the air inlet is provided with the connection for the air supply line, in particular approximately centrally, on the rear face of the upwardly protruding air channel, when viewed in the transverse direction.

Preferably, the inlet-side connection, the air distributor, the upwardly protruding air channel and the slotted blow-out channel of the air outlet are constituent parts of a blow-out-structural unit. This blow-out-structural unit can be configured, in particular, in one piece or integrally. Preferably, the blow-out-structural unit can be produced from plastic.

A blow-out-structural unit which is configured in such a manner is favorably able to be mounted on a front panel, in particular a base panel, which preferably terminates a potentially present base recess space of the dishwasher, except for an upper gap which remains free. To this end, the upwardly protruding air channel thereof is expediently arranged behind the rear face of the front panel, in particular the base panel (when viewed in the direction from the front in the depth direction), while the slotted blow-out channel of its air outlet protrudes over the upper edge of the front panel, in particular the base panel, in particular bears thereagainst. The air channel is thus concealed by the front panel, in particular the base panel, i.e. is not visible from the front. Due to the slotted shape of the blow-out channel this is barely visible from the front on the upper edge of the front panel. In particular, the air channel can be mounted on the rear face of the front panel, in particular the base panel —preferably in a releasable manner. When the dishwasher has a base recess space, the blow-out-structural unit can be arranged such that its air channel comes to rest behind the base panel in the intermediate space between the rear face thereof and the front face of the base of the dishwasher.

In particular, the sub-flows diametrically oppose one another. The sub-flows can run from the air distribution unit to both transverse edges of the dishwasher and escape to the front on this path or in some instances only after being reflected at a termination of the path on the edge side.

The air distributor is favorably arranged at least approximately centrally in the direction of the width relative to the extent of the air outlet, so that paths of approximately the same length result for both sub-flows and thereby the escape of air to the front is also substantially uniform over the width.

If, relative to the vertical height of the dishwasher, the air distributor is at least partially held in a plane below the air outlet and at that point conveys the air directly into a channel which extends parallel to the air outlet, the in particular warm (dishwasher-interior) air can rise upwardly from the channel and escape from the air outlet. Potentially condensed water can be retained in the channel and, in particular, run down through at least one drain back into the dishwasher, so that the external space is kept substantially free of moisture.

If the channel is upwardly open, and an upper edge of the channel adjoins the horizontally extending air outlet at an angle from the air outlet, the path for the warm air or the warm, humid dishwasher-interior air into the room is very short. The escape of air which escapes upwardly via the channel, which is only a few centimeters high, takes place in a reliable and complete manner.

If the air outlet is at least 40 centimeters wide overall (in particular relative to a household dishwasher having an appliance width of approximately 60 cm) it is possible to achieve a very wide and uniform distribution of the moisture and the escaping air. Particularly favorably, the width of the air outlet can take up approximately the entire appliance width.

In particular, the air outlet is configured as a flat slotted outlet with a height-to-width ratio of less than 1:20, in particular of between 1:20 and 1:200, preferably of approximately 1:100. In spite of the very low height, structurally and visually, a large discharge surface area can be achieved thereby.

It is very advantageous if the air outlet is arranged on the front face of the dishwasher facing a user and blows out the air with a forward component. The blown-out air is thus conducted away from the kitchen furniture and the collection of moisture in the installation space of the kitchen furniture is thus avoided. Thus the air which escapes there and which is frequently laden with moisture can be rapidly mixed with the drier external air in the kitchen and over a large area.

If the air outlet overlaps a base panel which terminates a base to the front and protrudes relative thereto at least to the same distance toward the front face, the humid air can escape sufficiently far to the front that it does not deposit too much moisture either on the kitchen floor or the front face of the dishwasher, in particular the front door thereof. At first, the airflow can flow out at an initial speed in an approximately horizontal direction and, due to its high temperature, can be provided with a rising component upwardly at a distance in front of the dishwasher.

Moreover, after dismantling the base panel, the air outlet together with an air distribution unit, which is fluidically arranged upstream thereof and which comprises the air distributor and optionally preferably an upwardly protruding air channel which is upstream of the air outlet, and in particular a rear connection, can be favorably moved together out of the base (as blow-out-structural unit), and at the same time an air supply line which is designed with an excess length, in particular a flexible connecting hose or a corrugated pipe which supplies the connection, can remain held in a mounted position. The mounting and dismantling are thus highly simplified.

A high degree of efficiency can be achieved when the air outlet can be activated by at least one conveying member, such as a fan wheel, which is arranged in the lower region of the dishwasher behind the air outlet in the depth direction. The fan wheel or the like can be located approximately at the same height as the air outlet itself and arranged in a space-saving manner in the base of the dishwasher.

Preferably, the blow-out-structural unit has an air distribution channel which in its final mounting position protrudes upwardly and extends in the width direction, the blow-out channel of the, in particular slotted, air outlet extending to the front face and adjoining the upper end thereof, and the air distribution channel has a connection, in particular on the rear face, for an air supply line. Thus in the final mounted position of the blow-out-structural unit, when viewed in the vertical direction, the air distribution channel is located lower, i.e. below the, in particular slotted, blow-out channel which extends or protrudes to the front. In the final mounting position of the blow-out-structural unit, in particular, the air distribution channel is favorably arranged behind the front base panel of the dishwasher. In particular, the air distribution channel is mounted on the rear wall thereof in a releasable manner. Preferably, the hollow space of the air distribution channel is closed at its lower end in an air-tight and/or water-tight manner, so that in its lower region it forms a condensation collecting tank. In its preferably rear air inlet, the air distribution channel has the air distributor for separating the supplied airflow into the two sub-flows, in particular a left-hand and a right-hand sub-flow.

In particular, the blow-out-structural unit, which comprises the blow-out channel, the air distribution channel which is arranged upstream of the blow-out channel and which protrudes upwardly, the air distributor in the preferably rear air inlet of the air distribution channel and the connection for the air supply line, is configured in one piece or integrally, i.e. it forms a single component. As a result, the mounting/dismantling thereof is highly simplified. Preferably, the blow-out-structural unit is produced from plastic, in particular by plastic injection-molding.

If dishwasher-interior air is blown out from the dishwasher interior of the dishwasher cavity by means of the blow-out-structural unit into the open, i.e. into the surroundings at the respective positioning location or installation location of the household dishwasher which is configured according to the invention, during at least one drying phase the front door of the household dishwasher which is preferably pivotable about a lower horizontal pivot axis which is oriented in the transverse direction or width direction, in particular, remains shut, i.e. closed. Thus it is possible to avoid the situation where humid dishwasher-interior air from the opening gap, between the upper part of the front door and the dishwasher cavity, leaves this gap, rising upwardly, and deposits condensate from the outflowing warm, humid dishwasher-interior air onto items of kitchen furniture located above the opening gap, such as for example a kitchen countertop, which could lead to moisture damage there. It is also possible to avoid uncontrollable and/or excessive heat losses from the dishwasher interior of the dishwasher cavity into the surroundings, which would be associated with a door being open ajar and which would impair the drying efficiency of the respective drying phase. Additionally, by the front door remaining closed during the respective drying phase, it is possible to avoid the situation where dirt particles such as dust particles and/or germs and/or other foreign bodies can pass from the surroundings into the dishwasher interior onto the items to be washed, which have been previously washed clean by means of detergent. Finally, by the front door remaining closed it is also substantially possible to avoid operating errors and/or misinformation, which could be caused by the user leaving a front door open ajar. Thus a user often incorrectly interprets a front door being open ajar as the end of a dishwashing program, even though the program-terminating drying phase thereof is not yet finished.

The household dishwasher which is configured according to the invention provides, in particular, one or more dishwashing programs in which in each case detergent or washing liquor is applied to the items to be washed which are to be cleaned in the dishwasher interior of the dishwasher cavity of the household dishwasher in one or more liquid-conducting sub-washing phases such as a prewash phase, cleaning phase, intermediate washing phase, rinse aid phase, and then dried in a drying phase terminating the washing program by means of the blow-out-structural unit according to the invention, with the front door remaining closed, in order to be able to remove the items to be washed, which are dried as fully as possible and without water stains, subsequently from the dishwasher cavity after opening the front door. Optionally a so-called "storage function phase" or storage phase can follow for a predetermined time period at the end of the drying phase of the respective dishwasher program, until it is ensured by means of one or more additional drying phases that, until this time period has elapsed, the items to be washed in the dishwasher interior continue to remain dry when the front door of the household dishwasher remains closed. This "storage function phase" can preferably last over several days. Additionally or independently, other operating functions of the household dishwasher can also be provided by the blow-out-structural unit according to the invention. For example, an odor removal program can be implemented in which dishwasher-interior air can be blown out into the surroundings of the household dishwasher and fresh air suctioned into the dishwasher interior by means of the blow-out-structural unit, when there is the risk of bad odors forming in the dishwasher interior. This can occur, for example, after the end of the last dishwashing program and the clearing of the clean and dried items to be washed, when newly soiled items to be washed are introduced into the dishwasher interior of the dishwasher cavity and then stored for a lengthy time in the dishwasher interior of the dishwasher cavity with the front door closed until the next dishwashing program is started.

A favorable development of the invention provides that the fan wheel or a similar conveying member can be activated in a clocked manner or even continuously, and during the drying phase of the respective dishwashing program and/or even beyond the end of this drying phase over a time period of several days. In the last case the household dishwasher can favorably serve as an item of storage furniture or a store for items to be washed, such as dishware, glasses, cutlery and the like, and can repeatedly re-dry over several days in phases or even continuously these items to be washed which were previously washed and dried during the dishwashing program respectively carried out. The front door of the household dishwasher preferably remains closed in each case, both during the regular drying phase of the dishwashing program respectively to be carried out and during a potentially chronologically following "storage function phase". This storage of the items to be washed in the dishwasher interior of the dishwasher cavity, preferably with the front door remaining closed, chronologically following the end of the drying phase of the dishwashing program respectively previously carried out, is denoted by "storage function phase". The conveying member can be activated both for the operation thereof during the drying phase of the respective dishwashing program and during the potentially chronologically following "storage function phase" if required, by detecting moisture in the dishwasher interior of the dishwasher cavity.

Further advantages and features are found in the exemplary embodiments of the subject matter of the invention shown in the drawing and described hereinafter.

DETAILED DESCRIPTION OF EXEMPLARY EMBODIMENTS OF THE PRESENT INVENTION

Figure 1:
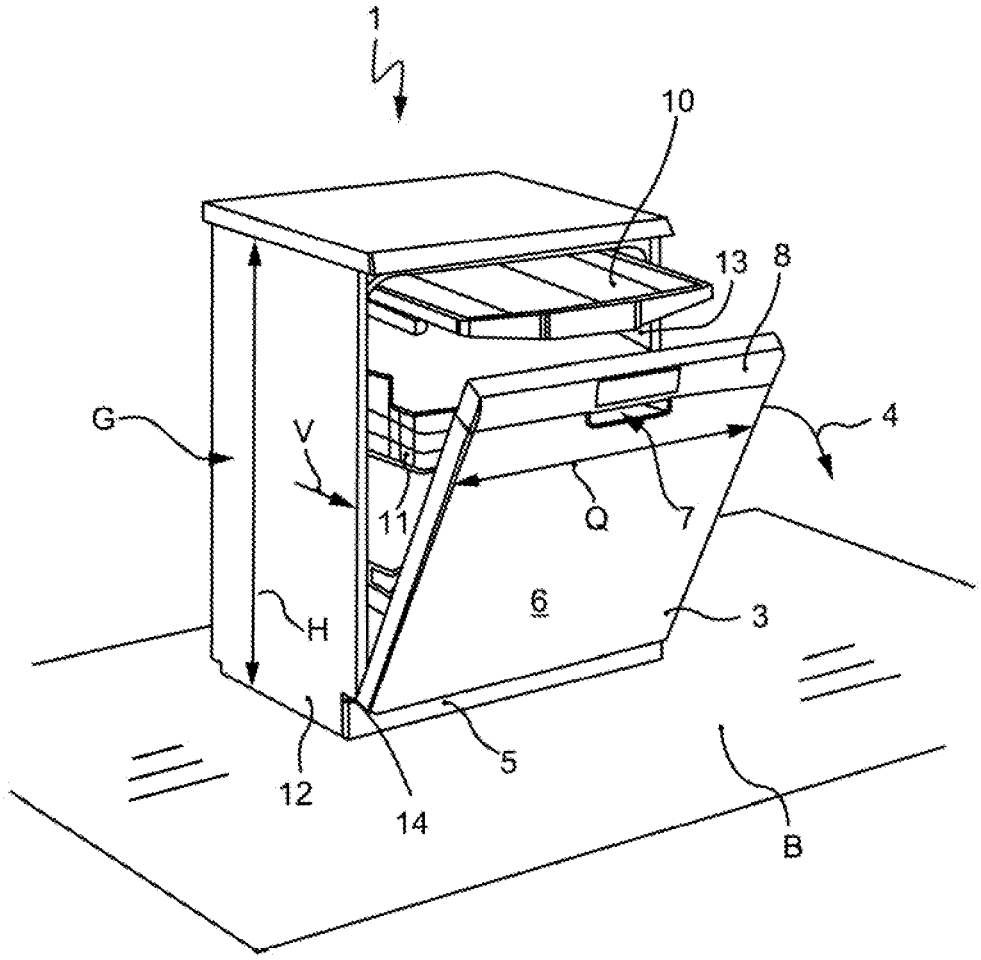
FIG. 1 shows a schematic perspective view obliquely from the front of an advantageous embodiment of a dishwasher, in particular a household dishwasher, preferably with a recessed base in the lower region, wherein a blow-out-structural unit with an air outlet is arranged in the base recess space.

The household appliance 1 shown here schematically in FIG. 1 is a dishwasher 1, specifically a household dishwasher. Other household appliances 1 with a drying function for the items to treated are also relevant in principle for a configuration according to the invention.

The household dishwasher 1, which is described hereinafter according to FIG. 1, has a dishwasher cavity 2 for receiving items to be washed and to be treated, such as dishware, pots, cutlery, glasses, cooking utensils, and the like, as a constituent part of an appliance body G which is partially open or closed outwardly. The items to be washed can be held, for example, in dishware baskets 11 and/or a cutlery drawer 10 and so-called washing liquor can be applied thereto. "Washing liquor" is understood to mean in this case fresh water or, in particular, water circulating during operation with or without detergent and/or rinse aid and/or drying agent. In particular, the washing liquor has an ion exchanger for softening. The washing liquor can additionally be subjected to a greater or lesser extent to contamination from the ongoing operation. The dishwasher cavity 2 can have an at least substantially rectangular footprint with a front face V facing a user in the operating position. This front face V can form at the same time a part of a kitchen front consisting of items of kitchen furniture standing adjacent to one another or a stand-alone appliance without relating to other items of furniture.

The dishwasher cavity 2, in particular, can be closed on this front face V by a front door or flap 3. This door 3 is shown in FIG. 1 in the partially open position and thus obliquely to the vertical. In its closed position, however, the door stands upright and, according to the drawing, for the opening thereof is able to be pivoted open toward the front about a lower horizontal axis and downwardly in the direction of the arrow 4 so that it is located at least approximately horizontally in the fully open position.

On the vertical outer face and front face V of the dishwasher 1 facing the user, in the closed position, the front door 3 can be provided with a decorative panel 6 in order to achieve thereby a visual and/or haptic enhancement and/or an adaptation to the surrounding kitchen furniture.

The household dishwasher is configured here as a free-standing appliance or as a so-called partially integrated or fully integrated appliance. In the last-mentioned case the appliance body 5 can also be substantially terminated by the external walls of the dishwasher cavity 2. A housing outwardly surrounding the dishwasher cavity can then be dispensed with. In the lower region of the household dishwasher is located a base 12 to which the dishwasher cavity 2 is attached and which in particular serves for receiving functional elements of the household dishwasher, such as for example a pump for circulating the washing liquor, a drainage pump, a pump sump, a control device, etc. An air outlet 14, which is to be described in more detail below, is provided in the base 12 itself or, as provided here in the exemplary embodiment, in the front recess space thereof, said air outlet partially overlapping a front panel 15 visually terminating the front of the base or the base recess space toward the front face V.

The movable front door 3 in the exemplary embodiment, according to the drawing, is assigned in its upper region a front control panel 8 which extends in the transverse direction Q of the household dishwasher, and which can comprise an access opening 7 which is accessible from the front face V for manually opening and/or closing the door 3. In the transverse direction Q the household dishwasher frequently has an extent of 45, 50 or 60 centimeters. In the depth direction T from the front face V to the rear, the extent is also frequently approximately 60 centimeters. The values are not mandatory. Moreover, the household dishwasher 1 does not have to stand directly on a floor B, for example of a kitchen, but can also be fitted approximately at eye level within an item of kitchen furniture, so that the problem mentioned in the introduction of an air draft through an air outlet 14 can be taken into account, in particular. With a fully integratable household dishwasher, the front control panel 8 in the upper region of the front door can be omitted and replaced by the control panel in the upper edge of the front door. Other arrangements of the control panel on and/or in the front door are also possible. Optionally the control panel can be completely dispensed with, for example when the operation of the household dishwasher can be controlled and/or monitored by a mobile communication device such as a smartphone, for example.

The dishwasher interior of the dishwasher cavity 2 is defined over the periphery, when the front door or flap 3 is closed, by a total of three fixed vertical walls 13 and two horizontal walls 13, one thereof forming a ceiling (above) and another forming a bottom (below) of the dishwasher cavity 2. A left-hand upright side wall 13 to the left, and a right-hand upright side wall 13 to the right, adjoin the front face V facing the user in the transverse direction Q.

The wall 13 forming the bottom of the dishwasher cavity 2 and defining this dishwasher cavity substantially downwardly is located approximately horizontally above the base 12, i.e. parallel to an external floor B on which the household dishwasher 1 can stand. A higher installation, for example approximately level with a countertop, is also possible as discussed, in particular within a cabinet. The lower edge of the dishwasher 1 is then located in the installed position approx. 70 to 110 centimeters above the floor.

The dishwasher 1 is provided with at least one air outlet 14 for blowing out air, in particular humid air, from the dishwasher cavity 2. This air outlet 14 can blow out air, in particular humid air, from the dishwasher interior of the dishwasher cavity into the free air space on the front face V of the dishwasher 1 facing a user, so that the humid air is not drawn inside a row of kitchen units and is not able to cause damage there due to the moisture. The blowing out of air, in particular humid dishwasher-interior air, via the air outlet 14 preferably takes place during the program-terminating drying phase of a dishwashing program to be carried out and/or during at least one additional drying phase of a chronologically following "storage function phase". In any case, the front door 3 remains closed.

Figure 2:
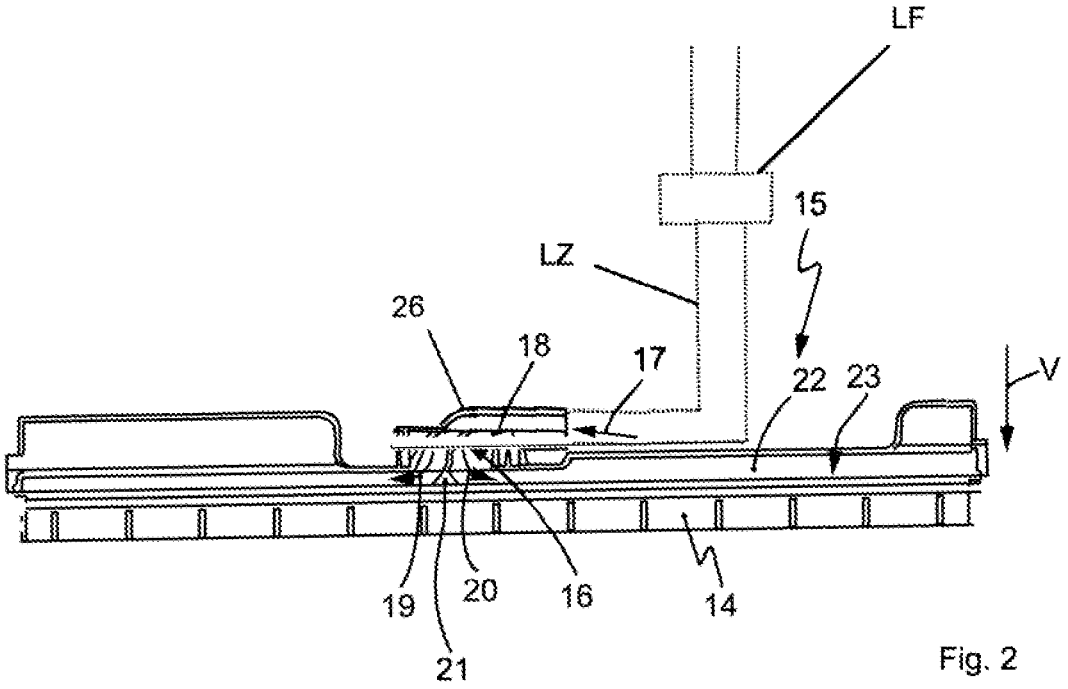
FIG. 2 shows a view from above of the blow-out-structural unit of the dishwasher of FIG. 1 comprising an air outlet, wherein the blow-out-structural unit has on the rear face of the air outlet an air distributor and an (air distributor) channel for guiding the sub-flows formed by the air distributor.

The air outlet 14 is a constituent part of a blow-out-structural unit 15 which is shown by way of example in FIG. 2 as a whole. The blow-out-structural unit 15, comprising the at least one air outlet 14, extends over at least half of the width Q of the dishwasher 1, in particular even more. Thus a particularly uniform distribution of the escaping air can be achieved, so that the occurrence of air drafts is minimized.

The blow-out-structural unit 15 can be formed as a whole from plastic. Moreover, the air outlet 14 can be divided into a plurality of partial slots which are aligned adjacent to one another. These slots do not all have to be of equal length. It is important that an air outlet 14 which extends over the width and which permits a high throughflow of air is provided as a whole, in order to achieve in this manner a wide distribution of the moisture contained in the air.

Figure 3:
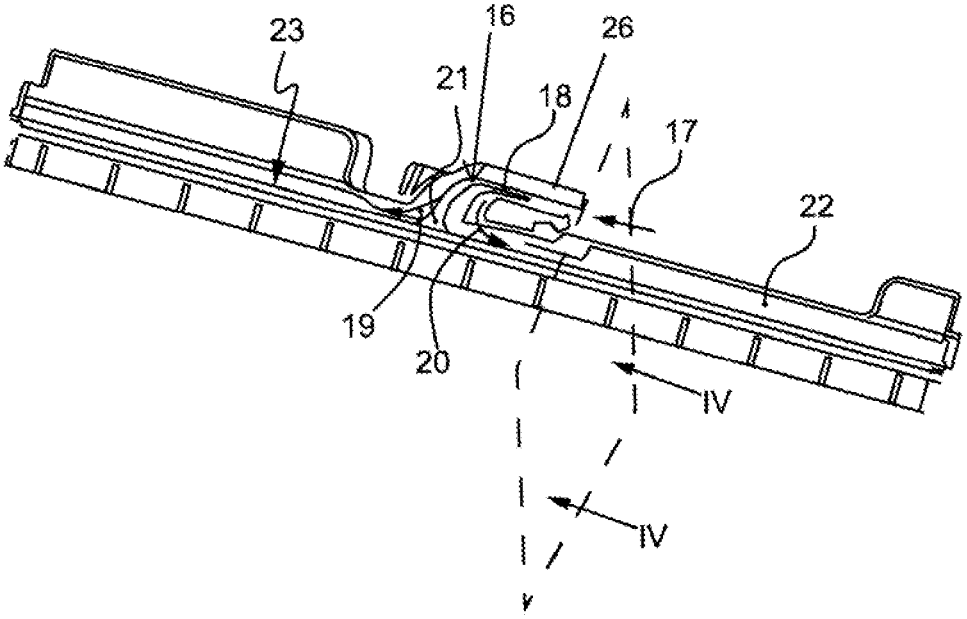
FIG. 3 shows a perspective view obliquely from above of the blow-out-structural unit according to FIG. 2.
Figure 4:
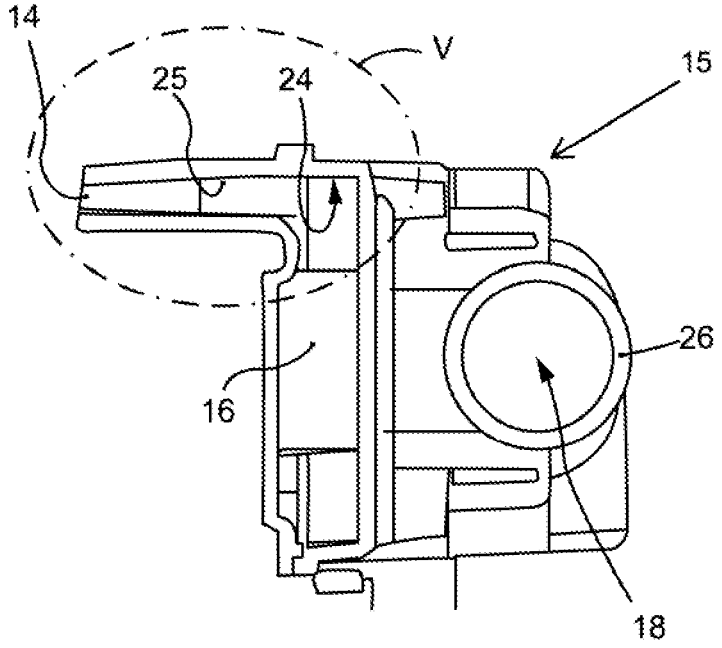
FIG. 4 shows a partial sectional view of the blow-out-structural unit approximately corresponding to a view in the cutting plane IV-IV in FIG. 3.
Figure 5:
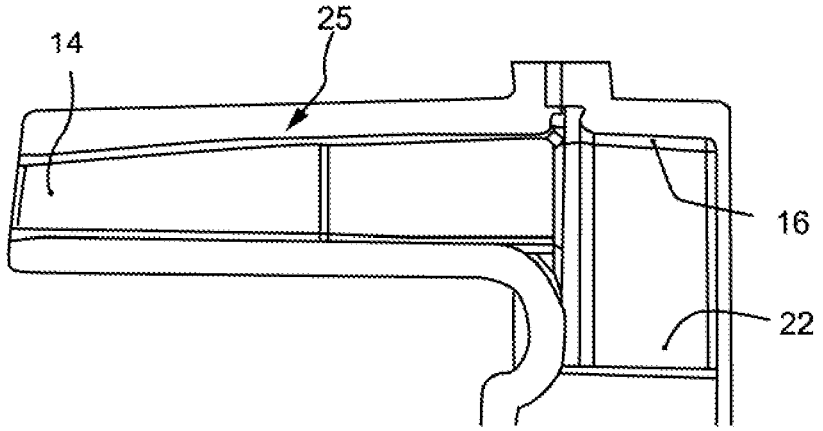
FIG. 5 shows a detailed view approximately corresponding to the detail V in FIG. 4.

The air outlet 14 is arranged here in the lower quarter of the appliance height and extends as a one-piece or multi-piece slotted outlet over at least half, in particular over at least two thirds, of the width Q of the dishwasher 1. In particular, the air outlet 14 is at least 40 centimeters wide (in particular with a household dishwasher with a 60 cm appliance width). The air outlet can extend, as clearly identifiable in FIGS. 2 and 3, over approximately the entire width Q of the dishwasher 1. At least one connection 26 of the blow-out-structural unit 16—preferably located here on the rear face of the air outlet 14—is provided for conveying humid air from the dishwasher interior of the dishwasher cavity 2 into the air outlet 14. The dishwasher-interior air introduced through this connection 26 can be initially supplied to an air distributor 16 which protrudes into the cross section of the connection 26, which in this case is tubular, and separates the airflow 17 approximately centrally. In particular, the start of the air distributor 16 forms a narrow upright rib 18 to the left and right of the sub-flows 19, 20.

The rib 18 transitions into a curved air guiding element 21 which protrudes with its end facing away from the rib 18 into an air distribution channel 22 which is arranged behind the air outlet 14 (i.e. facing away from the front face V). The channel 22 has a significantly greater height relative to the air outlet 14 and can have on its lower face drains for condensed water—not illustrated here. Preferably, the channel 22 is closed at its lower end in an air-tight and/or water-tight manner, so that in its lower region it has a condensate collecting tank.

The air guiding element 21 widens in the air distribution channel 22, in a view from above, similar to a triangle with rounded sides and extends to a front channel wall 23. As a result, it is ensured that the sub-flows 19, 20 which are formed in the channel 22 do not mix again.

Rather, the sub-flows 19, 20 in the channel 22 diametrically oppose one another and run from the ideally central air distributor 16 relative to the transverse direction Q approximately to the two outer walls of the dishwasher 1. The sub-flows 19, 20 have a sufficiently high speed in order to maintain approximately a uniform density on their opposing paths through the channel 22, before the air can escape therefrom with an upward and forward component, as is described hereinafter:

The above-mentioned channel 22 extends parallel to the air outlet 14 in the width direction Q of the dishwasher 1. In this case, relative to the vertical height H of the dishwasher 1, the air distributor 16 is at least partially held in a plane below the air outlet 14, as is the channel 22 in which air is introduced by the air distributor 16. The air from the air distributor 16 thus does not escape directly through the air outlet 14 but passes first with its sub-flows 19, 20 through the channel 22 in both directions. By the further conveyance of air, the air is continually pushed out upwardly in the upwardly open channel 22 and due to the upper baffle 24 then only has the opportunity to flow to the side and to the front into the air outlet 14.

This is possible since the channel 22 is open upwardly and an upright front channel wall 23 adjoins the horizontally extended air outlet 14 at an angle, which ideally in the width direction Q has an extent of similar size to the channel 22, in particular at least 40 centimeters.

In particular, to this end the—one-piece or multi-piece—air outlet 14 according to FIG. 2 is configured as a flat slotted outlet, the height-to-width ratio thereof being able to be less than 1:20, in particular between 1:20 and 1:200, preferably approximately 1:100. Thus with a 40 centimeter wide air outlet 4, the height thereof in the vertical direction H is less than approx. 2 centimeters. Thus it is ensured that, on the one hand, the air outlet takes up less constructional space in the vertical direction H and, on the other hand, the overall extent of the air outlet 14 is sufficiently large in order to convey a high volume of air and thus to keep the air drafts very small.

Figure 6:
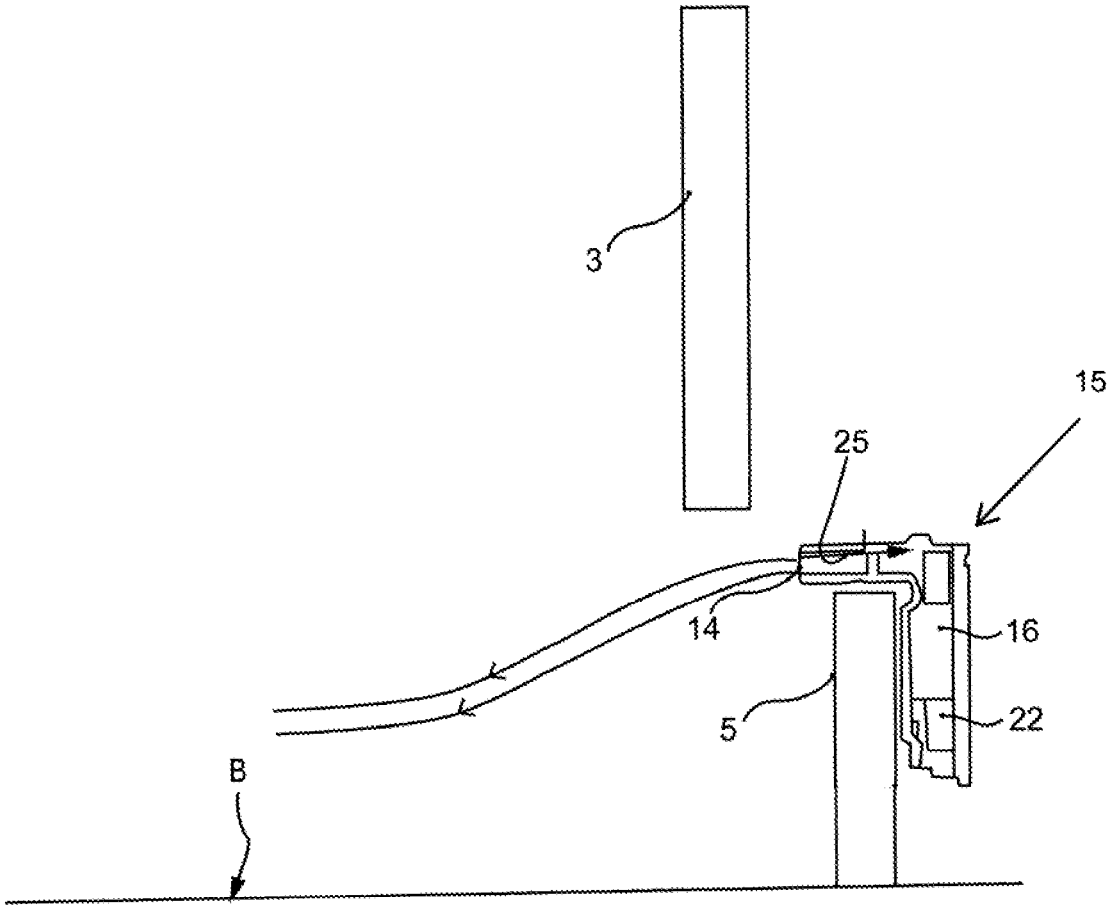
FIG. 6 shows a schematic side view of the front region of the dishwasher with the installed position of the air outlet and the resulting airflow which is blown out to the front.

In order to avoid moisture damage by the blown-out humid air, the air outlet 14 is arranged on the front face V of the dishwasher 1 facing a user and blows out the air with a forward component, such that the air does not directly rise but due to its initial speed is carried up to at least a few centimeters in front of the appliance, before a rising component becomes effective since the blown-out air is generally warmer than the surrounding ambient air (FIG. 6).

As can also be clearly identified in FIG. 6, the air outlet 14 can overlap a base panel 5, which terminates a base 12 to the front, and protrude relative thereto at least to the same distance toward the front face V. The base 12 with its front panel 5 can be recessed by a few centimeters relative to the front door 3, but it is possible to avoid wetting the lower edge of the front door 3 and in particular the lower edge of a decorative panel or furniture panel potentially mounted on the front face, such as for example at 6, by the forward facing component of the air outlet speed. Additionally, an upper guide 25, for example an upper wall, of the air outlet can be arranged slightly obliquely such that the escaping air is blown out by a few degrees downwardly into the room. The air outlet is thus not entirely horizontal but can be conducted by the downward component below the door 3, without causing moisture damage there. The wide extent of the air outlet 14 prevents a disruptive air draft.

After possibly dismantling the base panel 5, the air outlet 14 together with the air distribution unit arranged fluidically upstream thereof, which in particular comprises the channel 22 and the air distributor 16, and the rear connection 26, can be moved out together as a blow-out-structural unit 15 from the base 12, but an air supply line designed with an excess length, in particular a flexible connecting hose or a corrugated pipe, which supplies the connection 26 with air from the dishwasher interior of the dishwasher cavity, can remain held in a mounted position. This is particularly simple in terms of maintenance. In FIG. 2 the air supply line LZ is indicated by dotted lines.

For suctioning the dishwasher-interior air from the dishwasher interior of the dishwasher cavity and blowing out this dishwasher-interior air via the blow-out-structural unit, at least one conveying member such as for example a fan can be provided in or in front of the connection 26 thereof, said fan also being able to be activated in a clocked manner, even over a time period of several days. In FIG. 2, an air conveying member LF, such as for example a fan, is incorporated in the air supply line LZ. In FIG. 2 the fan is only shown schematically as a dotted rectangle. The air supply line is connected with its end on the upstream side to an air outlet opening which is provided in one of the defining walls of the dishwasher interior, in particular in a wall, preferably a side wall, of the dishwasher cavity.

Favorably, in particular, a dishwasher with the following advantageously configured blow-out-structural unit 15 for mounting on a base panel 5, in particular a floor base panel, can be advantageous:

In particular, the air distributor 16 of the blow-out-structural unit 15 is assigned to the inlet-side connection 26 and/or is arranged downstream thereof in the direction of flow. The air distributor is arranged upstream of the slotted blow-out channel of the air outlet 14. This air distributor 16 preferably separates the dishwasher-interior airflow, which is supplied to the connection 26, into a left-hand sub-flow and a right-hand sub-flow. In this case, the left-hand sub-flow is fed into the left-hand portion and the right-hand sub-flow is fed into a right-hand sub-portion of the upwardly protruding air channel 22. This air channel 22, when viewed in the direction of flow, is arranged upstream of the slotted blow-out channel of the air outlet 14. The air channel is preferably located lower than the air outlet, when viewed in the vertical direction. The air channel preferably extends substantially over the same width extent as the blow-out channel. In particular, the upper end thereof is connected to the inlet of the blow-out channel extending to the front over the entire width thereof (when viewed from the front). The air inlet with the connection 26 is preferably provided approximately in the center of the width extent of the air channel 22 in the rear wall thereof. The upwardly protruding air channel 22 can thus advantageously function as a condensation region. Preferably, the hollow space of the air channel 22 is closed at its lower end in an air-tight and/or water-tight manner, so that in its lower region it forms a condensate collecting tank. In this manner, when viewed from the front, the air distributor 16 ensures that a left-hand sub-flow of the dishwasher-interior airflow, which is supplied to the inlet-side connection 26, acts on the left-hand half of the upwardly protruding air channel 22 upstream of the air outlet 14 and the adjoining left-hand half of the blow-out channel of the air outlet 14, which extends to the front and in the width direction or transverse direction, and a right-hand sub-flow of the dishwasher-interior airflow, which is supplied to the inlet-side connection 26, acts on the right-hand half of the upwardly protruding air channel and the adjoining right-hand half of the blow-out channel of the air outlet 14, which extends to the front, when the air inlet is provided with the connection for the air supply line, in particular approximately centrally, on the rear face of the upwardly protruding air channel, when viewed in the transverse direction.

Preferably, the inlet-side connection, the air distributor 16, the upwardly protruding air channel 22 and the slotted blow-out channel of the air outlet 14 are constituent parts of the blow-out-structural unit 15. This unit can be configured, in particular, in one piece or integrally. Preferably, this unit can be produced from plastic.

The blow-out-structural unit 15 thus configured is able to be favorably mounted on a front panel 5, in particular a floor base panel—for example as shown schematically in FIG. 6 in side view—which preferably terminates a potentially present base recess space of the dishwasher, except for an upper gap remaining free between the lower edge of the front door 3, which is potentially provided with a decorative panel or furniture panel, and the upper edge of the panel 5. Expediently, the upwardly protruding air channel 22 thereof (when viewed from the front in the depth direction) is arranged behind the rear face of the front panel 5, in particular the base panel, while the slotted blow-out channel of its air outlet 14 protrudes over the upper edge of the front panel 5, in particular the base panel, in particular bears thereagainst. The air channel 22 is thus concealed by the front panel 5, in particular the base panel, i.e. it is not visible from the front. Due to the slotted shape of the blow-out channel, it is barely visible from the front on the upper edge of the front panel, in particular the floor base panel. In particular, the air channel 22—as in the exemplary embodiment of FIG. 6—can be mounted on the rear face of the front panel 5, in particular the base panel, preferably in a releasable manner. In the case of a floor base panel—as shown in FIG. 6—this is located on the floor B.

A dishwasher 1 which is configured according to the principle according to the invention is not only able to carry out the program-terminating drying phase of a dishwashing program respectively to be carried out, but if required can also be easily provided with a so-called "storage function" which makes it possible for the items to be washed to remain in the dishwasher cavity 2 after the treatment without becoming wet again. The items to be washed can remain in the dishwasher cavity for several days without impairing the dryness of the items to be washed. The dishwasher 1 then also serves as a storage and drying cabinet from which the items to be washed can be removed fresh and dry.

In particular for the "storage function", the conveying member can be activated, in particular, in a clocked manner. Alternatively, and particularly effectively, the conveying member is activated via a moisture sensor system which provides a measurement of the current moisture level of the items to be washed located in the dishwasher cavity.

In both cases the conveying member is only switched on now and again in order to convey humid air repeatedly out of the dishwasher cavity 2 and thus to preserve the quality of the cleaning of the items to be washed, even over a lengthy time period. Due to the short effective running times, the energy consumption is low—and also the noise emitted by the at least one fan wheel or similar conveying member.

If required, however, it can also be advantageous if the conveying member is operated continuously with air to be blown out, in particular dishwasher-interior air, during the drying phase of the respective dishwashing program and/or during the entire time period of a potentially chronologically following "storage function phase" and/or another operating phase of the household dishwasher.

The invention claimed is:

1. A dishwasher, comprising:

a dishwasher cavity for treatment of items to be washed;

an air outlet for blowing out air from the dishwasher cavity, said air outlet arranged in a lower quarter of a height of the dishwasher and extending as a slotted outlet over at least two thirds of a width of the dishwasher;

an air distributor;

a connection coupled to the air outlet for introducing humid air from the dishwasher cavity into the air outlet, said connection designed to supply the introduced air from the dishwasher cavity to the air distributor, the air distributor configured to separate the supplied air into at least two differently oriented sub-flows that diametrically oppose one another; and a channel wall extending parallel to the air outlet and defining a channel comprising at least two portions separated by an air guiding element coupled to the channel wall, each portion of the channel configured to receive a respective sub-flow of the at least two differently oriented sub-flows from the air distributor.

2. The dishwasher of claim 1, constructed in a form of a household dishwasher.

3. The dishwasher of claim 1, wherein the air distributor is arranged at least approximately centrally in a direction of the width relative to an extent of the air outlet.

4. The dishwasher of claim 1, further comprising the channel extending parallel to the air outlet, wherein, relative to a vertical height of the dishwasher, the air distributor is at least partially held in a plane below the air outlet and conveys the air directly into the channel.

5. The dishwasher of claim 4, wherein the air outlet extends substantially horizontally, said channel being upwardly open and having a front edge which adjoins the air outlet at an angle.

6. The dishwasher of claim 1, wherein the air outlet is at least 40 centimeters wide overall.

7. The dishwasher of claim 1, wherein the air outlet is designed as a flat slotted outlet with a height-to-width ratio of less than 1:20.

8. The dishwasher of claim 1, wherein the air outlet is designed as a flat slotted outlet with a height-to-width ratio of between 1:20 and 1:200.

9. The dishwasher of claim 1, wherein the air outlet is designed as a flat slotted outlet with a height-to-width ratio of approximately 1:100.

10. The dishwasher of claim 1, wherein the air outlet is arranged on a user-facing front face of the dishwasher and is designed to blow out the air with a forward component.

11. The dishwasher of claim 10, further comprising a base and a base panel which terminates the base to a front of the dishwasher, said air outlet overlapping the base panel and protruding relative to the base panel at least to a same distance toward the front face.

12. The dishwasher of claim 1, further comprising:

an air supply line designed with an excess length and supplying the humid air from the dishwasher cavity to the connection; and an air distribution unit fluidically arranged upstream of the air outlet and comprising the air distributor, wherein after dismantling a base panel that terminates a base of the dishwasher to a front of the dishwasher, the air outlet together with the air distribution unit and the connection is moveable out of the base as a blow-out structural unit while the air supply line remains in a mounted position.

13. The dishwasher of claim 12, wherein the air supply line is a flexible connecting hose or a corrugated pipe.

14. The dishwasher of claim 1, further comprising a conveying member for supply of air and designed to be activated in a clocked manner over a time period of several days.

15. The dishwasher of claim 14, wherein the conveying member is a fan.

16. The dishwasher of claim 14, wherein the conveying member is designed to be activated by detection of moisture in the dishwasher cavity.

* * * * *